US011247355B2

(12) United States Patent
Han et al.

(10) Patent No.: US 11,247,355 B2
(45) Date of Patent: Feb. 15, 2022

(54) RAZOR CARTRIDGE AND RAZOR ASSEMBLY USING THE SAME

(71) Applicant: DORCO CO., LTD., Seoul (KR)

(72) Inventors: Da Woon Han, Seoul (KR); Jong Jin Jeong, Seoul (KR); Dong Il Kim, Seoul (KR)

(73) Assignee: DORCO CO., LTD., Seoul (KR)

( * ) Notice: Subject to any disclaimer, the term of this patent is extended or adjusted under 35 U.S.C. 154(b) by 7 days.

(21) Appl. No.: 16/987,288

(22) Filed: Aug. 6, 2020

(65) Prior Publication Data

US 2021/0069922 A1 Mar. 11, 2021

(30) Foreign Application Priority Data

Sep. 11, 2019 (KR) ..... 10-2019-0112686

(51) Int. Cl.
*B26B 21/44* (2006.01)
*B26B 21/22* (2006.01)
*B26B 21/40* (2006.01)

(52) U.S. Cl.
CPC ..... *B26B 21/446* (2013.01); *B26B 21/225* (2013.01); *B26B 21/4012* (2013.01); *B26B 21/4018* (2013.01); *B26B 21/4025* (2013.01)

(58) Field of Classification Search
None
See application file for complete search history.

(56) References Cited

U.S. PATENT DOCUMENTS 4,809,432 A 3/1989 Schauble
5,168,628 A * 12/1992 Mock ..... B05B 11/0005 30/125
5,687,485 A 11/1997 Shurtleff et al.
5,761,814 A 6/1998 Anderson et al.
5,956,848 A 9/1999 Tseng et al.
(Continued)

FOREIGN PATENT DOCUMENTS

EP 1152872 12/2002
EP 2338652 4/2015

OTHER PUBLICATIONS

European Patent Office Application Serial No. 20191511.3, Search Report dated Feb. 2, 2021, 6 pages.

*Primary Examiner* — Hwei-Siu C Payer
(74) *Attorney, Agent, or Firm* — Lee, Hong, Degerman, Kang & Waimey PC

(57) ABSTRACT

At least one embodiment of the present disclosure provides a razor assembly including at least one shaving blade having a cutting edge, a blade housing, a receiving member, and an aid supplying member. The blade housing is configured to accommodate at least one shaving blade such that a width direction of the blade housing is in parallel with a longitudinal direction of the cutting edge and includes an inlet portion and a discharge portion configured to discharge a shaving aid delivered from the inlet portion. The receiving member is disposed on a rear surface of the blade housing and includes a receiving valve and a receiving hole formed on one side of the receiving valve. The aid supplying member includes a discharge end configured to discharge the shaving aid to the inlet portion. At least a portion of the discharge end, which is inserted into the receiving hole, is accommodated between the receiving valve and the blade housing.

12 Claims, 10 Drawing Sheets

(56) References Cited

U.S. PATENT DOCUMENTS

| | | | | |
|---|---|---|---|---|
| 5,956,851 | A | 9/1999 | Apprille et al. | |
| 6,041,926 | A | 3/2000 | Petricca et al. | |
| 6,052,903 | A | 4/2000 | Metcalf et al. | |
| 6,185,822 | B1 | 2/2001 | Tseng et al. | |
| 6,212,777 | B1 | 4/2001 | Gilder et al. | |
| 6,442,839 | B1 | 9/2002 | Tseng et al. | |
| 6,516,518 | B1 | 2/2003 | Garraway et al. | |
| 6,612,040 | B2 | 9/2003 | Gilder | |
| 6,684,513 | B1 | 2/2004 | Clipstone et al. | |
| 6,789,321 | B2 | 9/2004 | Simms | |
| 7,043,841 | B2 * | 5/2006 | Franzini | B26B 21/446 30/41 |
| 7,121,754 | B2 | 10/2006 | Bressler et al. | |
| 8,438,735 | B2 | 5/2013 | De Klerk | |
| 8,745,877 | B2 | 6/2014 | Szczepanowski et al. | |
| 8,826,543 | B2 | 9/2014 | Szczepanowski et al. | |
| 9,321,182 | B2 | 4/2016 | Bridges et al. | |
| 9,375,856 | B2 | 6/2016 | Bennik et al. | |
| 9,381,657 | B2 | 7/2016 | Xu et al. | |
| 9,656,401 | B2 * | 5/2017 | Burrowes | B26B 21/528 |
| 2002/0023351 | A1 * | 2/2002 | Simms | B26B 21/446 30/41 |
| 2002/0029478 | A1 | 3/2002 | Haws et al. | |
| 2004/0255465 | A1 * | 12/2004 | Pennella | B26B 21/446 30/41 |
| 2005/0123342 | A1 | 6/2005 | Bressler et al. | |
| 2005/0144786 | A1 | 7/2005 | Bressler et al. | |
| 2010/0236071 | A1 | 9/2010 | Szczepanowski et al. | |
| 2013/0145625 | A1 | 6/2013 | Xu et al. | |
| 2013/0326881 | A1 * | 12/2013 | Blatter | B26B 21/446 30/41 |
| 2021/0069922 | A1 * | 3/2021 | Han | B26B 21/225 |
| 2021/0069923 | A1 * | 3/2021 | Han | B26B 21/446 |

* cited by examiner

RAZOR CARTRIDGE AND RAZOR ASSEMBLY USING THE SAME

CROSS-REFERENCE TO RELATED APPLICATIONS

Pursuant to 35 U.S.C. § 119(a), this application claims the benefit of earlier filing date and right of priority to Korean Patent Application Number 10-2019-0112686, filed on Sep. 11, 2019, the contents of which are hereby incorporated by reference herein in its entirety.

TECHNICAL FIELD

The present disclosure in some embodiments relates to a razor cartridge and razor assembly using the same.

BACKGROUND

The statements in this section merely provide background information related to the present disclosure and do not necessarily constitute prior art.

In using a wet razor, several factors can cause discomfort to the user.

For example, the friction force generated between the blade housing and the skin, the cutting force applied to the hair during cutting, irritation to a wounded skin area, etc., may cause inconvenience to the user.

To reduce such discomfort, shaving aid such as shaving foam, shaving gel, and shaving cream are used.

Shaving aids include a lubricating component and can be applied to the user's skin, which can reduce irritation applied to the skin during shaving.

A recently available razor is adapted to store a shaving aid in a razor handle and discharge the stored shaving aid from the razor cartridge thereof (hereinafter called fluid spray razors).

U.S. Pat. No. 6,789,321 (hereinafter referred to as Patent Document 1), which is one of the conventional fluid spray razors, is adapted to deliver a shaving aid to a razor cartridge by using a conduit (hereinafter, a fluid supply conduit) provided in the razor handle and to discharge the shaving aid from the razor cartridge.

Specifically, the razor cartridge of Patent Document 1 may have a region to which a shaving aid is delivered (hereinafter, an inflow region), and a region from which the shaving aid is discharged (hereinafter, a discharge region) out of the razor cartridge.

On the other hand, according to Patent Document 1, as the razor cartridge pivots on the razor handle, the angle of the fluid supply conduit to the razor cartridge may be changed. This may, in turn, change the ejection direction of the shaving aid when ejected from the fluid supply conduit to the razor cartridge.

Accordingly, when the razor cartridge pivots causing the ejection from the fluid supply conduit to be misaligned with the inflow region of the razor cartridge, a portion of the shaving aid ejected from the fluid supply conduit may not be introduced into the inflow region.

The shaving aid that has not been introduced into the inflow region may accumulate in the surrounding region of the inflow region, which may cause a backflow of the shaving aid portion in a direction opposite to the ejection direction.

Another issue is with a reduced amount of shaving aid discharged from the discharge region to block a sufficient amount of shaving aid from being applied to the skin of the user.

Therefore, to solve the above-described deficiencies, there is a need for a fluid spray razor that can smoothly spray the shaving aid regardless of the degree of pivot of the razor cartridge.

SUMMARY

According to at least one embodiment, the present disclosure provides a razor assembly including at least one shaving blade having a cutting edge, a blade housing, a receiving member, and an aid supplying member. The blade housing is configured to accommodate at least one shaving blade such that a width direction of the blade housing is in parallel with a longitudinal direction of the cutting edge and includes an inlet portion and a discharge portion configured to discharge a shaving aid delivered from the inlet portion. The receiving member is disposed on a rear surface of the blade housing and includes a receiving valve and a receiving hole formed on one side of the receiving valve. The aid supplying member includes a discharge end configured to discharge the shaving aid to the inlet portion. At least a portion of the discharge end, which is inserted into the receiving hole, is accommodated between the receiving valve and the blade housing.

DETAILED DESCRIPTION

Figure 1:
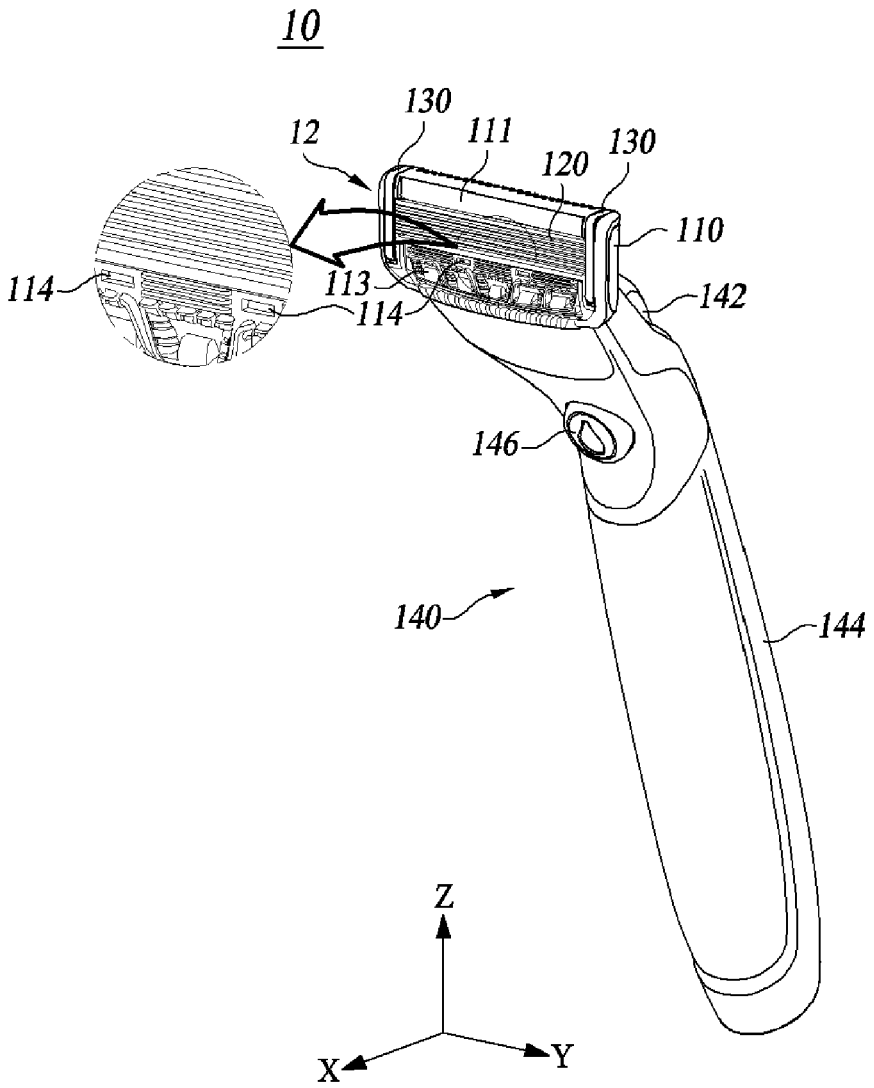
FIG. 1 is a perspective view of a razor assembly according to at least one embodiment of the present disclosure.

The present disclosure provides a razor assembly capable of preventing the backflow of the shaving aid regardless of the degree of pivot of the razor cartridge by using a receiving member for receiving the discharge end of an aid supplying member.

Exemplary embodiments of the present disclosure are described below with reference to the accompanying drawings. In the following description, like reference numerals would rather designate like elements, although the elements are shown in different drawings. Further, in the following description of the at least one embodiment, a detailed description of known functions and configurations incorporated herein will be omitted for the purpose of clarity and for brevity.

Additionally, alphanumeric code such as first, second, i), ii), (a), (b), etc., in numbering components are used solely for the purpose of differentiating one component from the other but not to imply or suggest the substances, the order or sequence of the components. Throughout this specification, when a part "includes" or "comprises" a component, the part is meant to further include other components, not excluding thereof unless there is a particular description contrary thereto.

FIG. 1 is a perspective view of a razor assembly 10 according to at least one embodiment of the present disclosure.

As shown in FIG. 1, the razor assembly 10 may include a razor cartridge 12 and a razor handle 140.

The razor cartridge 12 may include a blade housing 110, at least one or more shaving blades 120 and at least one or more clips 130.

The blade housing 110 may accommodate the shaving blades 120 having cutting edges. Here, the longitudinal direction of the cutting edges corresponds to the width direction of the blade housing 110. For example, in FIG. 1, the longitudinal direction of the cutting edges is a direction parallel to the Y-axis.

Once accommodated on one side of the blade housing 110, the shaving blades 120 may be retained by a plurality of clips 130.

The blade housing 110 may include a cap 111, a guard 113, and at least one or more discharge portions 114.

The cap 111 may be located rearward of the shaving blades 120, and specifically, may be disposed forward of the blade housing 110, which the cutting edges point to.

Here, the forward and rearward directions of the shaving blade 120 are defined based on the shaving direction of the razor cartridge 12. Accordingly, in FIG. 1, the forward and rearward directions of the shaving blades 120 are the negative Z-axis direction and the positive Z-axis direction, respectively, with respect to the shaving blades 120.

The guard 113, on the front side of the blade housing 110, may be located in front of the shaving blades 120.

During shaving, the guard 113 may stretch the skin in the direction of shaving prior to cutting the hair by the shaving blades 120.

This can erect the user's hair in a direction perpendicular to the user's skin surface, allowing the shaving blades 120 to cut the hair more easily.

Figure 3:
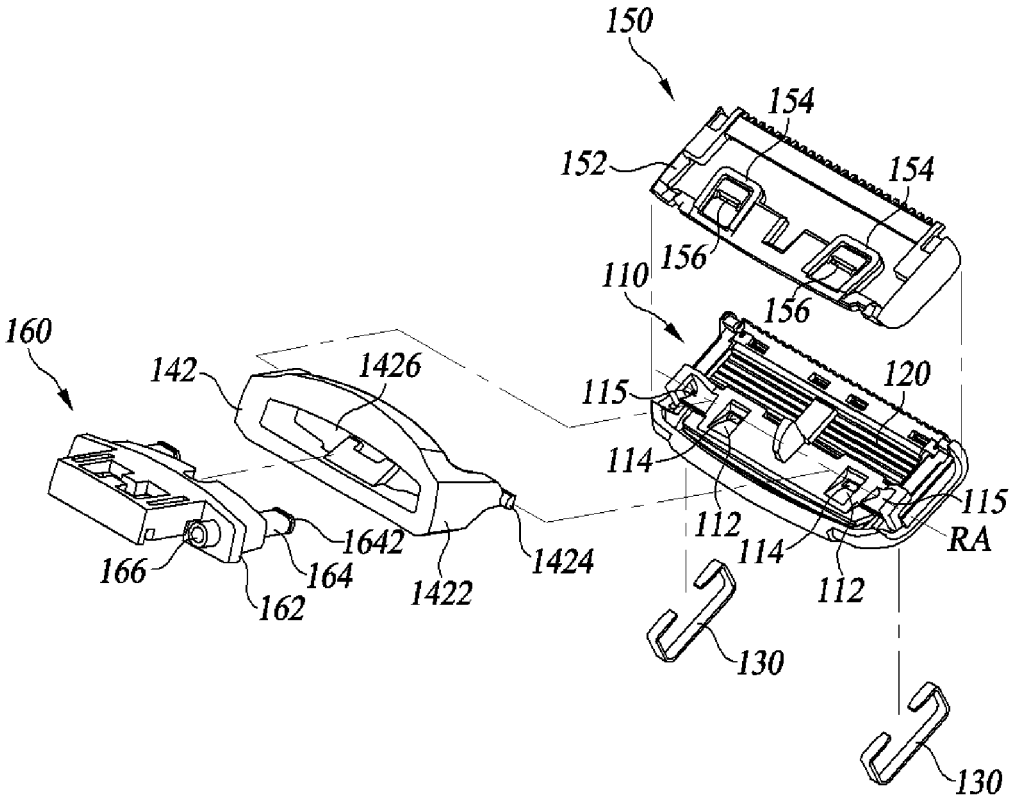
FIG. 3 is an exploded perspective view of a razor assembly according to at least one embodiment of the present disclosure.

The discharge portions 114 may be regions on the blade housing 110, through which a shaving aid is ejected or discharged after being delivered from at least one or more inlet portions 112 (FIG. 3).

Here, the shaving aid refers to various materials applied to the skin of a user in order to assist shaving. For example, the shaving aid may be one of, but not limited to, shaving foam, shaving gel, and shaving cream.

The shaving aid may be a fluid material but may be other materials having fluidity. For example, the shaving aid may be a solid material in the form of a powder or a fluid material having a solid material.

During shaving, for allowing the shaving aid to be applied to the user's skin, each discharge portion 114 may include an opening formed in the front surface of the blade housing 110.

The discharge portion 114 may be disposed forward of at least one shaving blade 120. This enables the shaving aid to be applied to the user's skin during shaving, before cutting the hair by the shaving blade 120. However, the present disclosure is not limited to this configuration.

For example, the discharge portion 114 may overlap the area on the blade housing 110 in which the shaving blade 120 is disposed, or may be disposed rearward of the shaving blade 120.

The clips 130 may clip the shaving blade 120 to the blade housing 110, thereby preventing the shaving blade 120 from being detached from the blade housing 110.

The razor handle 140 may include a head portion 142, a grip portion 144, and a discharge operating member 146.

The blade housing 110 may be coupled, pivotally, with respect to the head portion 142, about a rotation axis (RA) parallel to the longitudinal direction of the cutting edge.

The grip portion 144 may extend from the head portion 142 and provide the user with an area for gripping the razor assembly 10.

The head portion 142 and the grip portion 144 may be formed as separate members from each other, but the present disclosure is not limited thereto. For example, the head portion 142 and the grip portion 144 may be integrally formed.

The discharge operating member 146 may discharge a shaving aid from an aid supplying member 160 (FIG. 3) through a discharge action.

The discharge operating member 146 may include a button portion and an actuator. When pressed by the user, slid by the user or otherwise moved, the button portion may activate the actuator connected to it. The actuator serves to transfer the shaving aid stored in an aid storage to the aid supplying member. The actuator may employ a mechanism capable of injecting a fluid, such as a diaphragm valve or the like.

The razor assembly 10 employing the diaphragm valve mechanism may include an aid storage (not shown), an aid receiving space (not shown), a first valve (not shown) disposed between the aid supplying member 160 and the aid receiving space, and a second valve (not shown) disposed between the aid receiving space and the aid storage.

In this case, one side of the aid receiving space may be made of an elastic tube (not shown), and the discharge operating member 146 may be disposed adjacent to the elastic tube. The discharge operating member 146 may depress the elastic tube to discharge the shaving aid from the aid supplying member.

Specifically, when pressing the discharge operating member to depress the elastic tube, the shaving aid in the aid receiving space may pressurize the first valve to open thereof. As a result, the shaving aid in the aid receiving space may be delivered to the aid supplying member 160 through the first valve before it is discharged. When the shaving aid in the aid receiving space is discharged to some extent, the degree of pressure on the first valve is reduced, and the first valve may be closed.

Thereafter, upon releasing the discharge operating member, the elastic tube may be restored to the original position by the elastic force, whereby the pressure inside the aid receiving space may be lowered. This will generate a flow of shaving aid to be urged from the high-pressure aid storage toward the low-pressure aid receiving space, and this flow may pressurize the second valve to open the same.

Through this arrangement, the shaving aid stored in the aid storage may be delivered to the aid receiving space. When more than a certain amount of shaving aid is delivered to the aid receiving space, the pressure difference decreases between the aid storage and the aid receiving space, so that the second valve may be closed.

The shaving aid delivered to the aid receiving space may be stored therein until the next pressing operation of the discharge operating member 146.

Passing through the inlet portions 112, the shaving aid discharged from the aid supplying member 160 may be emitted from the discharge portions 114.

The discharge operating member 146 may have a configuration in which the shaving aid is discharged by a predetermined amount through a single action for discharge. However, the present disclosure is not limited to this configuration. For example, the discharge operating member 146 may be configured to discharge the shaving aid continuously while the discharge action is maintained.

Figure 2:
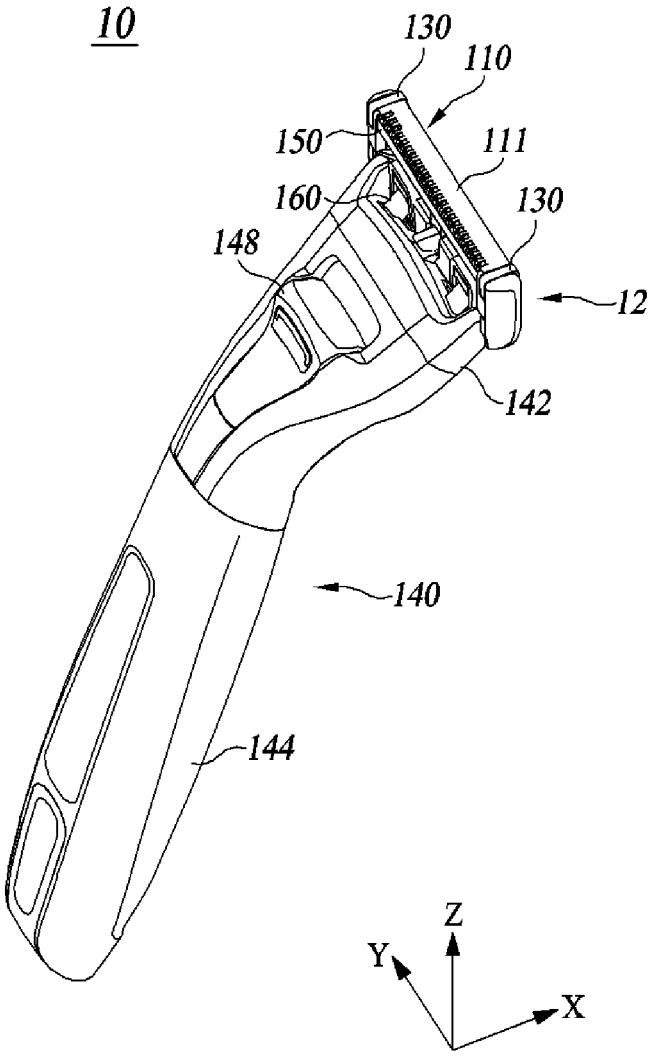
FIG. 2 is a rear perspective view of a razor assembly according to at least one embodiment of the present disclosure.

FIG. 2 is a rear perspective view of the razor assembly 10 according to at least one embodiment.

FIG. 3 is an exploded perspective view of the razor assembly 10 according to at least one embodiment.

As shown in FIGS. 2 and 3, the razor assembly 10 may include a receiving member 150 and the aid supplying member 160.

The receiving member 150 may be disposed on the rear surface of the blade housing 110, and it may include at least one or more receiving holes 156 through which at least portions of discharge ends 164 of the aid supplying member 160 are accommodated.

The receiving member 150 may be detachably coupled to the rear surface of the blade housing 110.

After detaching the receiving member 150 from the blade housing 110, the user can wash the rear surface of the blade housing 110. This process helps to wash or remove foreign matters accumulated in the inlet portions 112 and the discharge portions 114.

The aid supplying member 160 may include a supplying member body 162, the discharge ends 164, and at least one or more inlet portion ends 166.

The supplying member body 162 may be accommodated in a receiving space 1426 that is formed in the head portion 142.

The discharge end 164 may receive the shaving aid from the inlet portion ends 166 communicating with the discharge ends 164 and eject the shaving aid to the inlet portions 112.

Each discharge end 164 may be extended from one side of the supply unit main body 162, and at least a portion of the discharge end 164 may be inserted into the receiving hole 156 and accommodated in between the receiving valve 154 and the blade housing 110.

The discharge end 164 may include a protruding portion 1642 protruding from the outer peripheral surface of the discharge end 164.

The protrusion portion 1642 may be accommodated between the receiving valve 154 and the blade housing 110.

The shaving aid ejected from the discharge end 164 is blocked by the protrusion portion 1642 from flowing backward in the direction opposite to the ejection direction. This can minimize the undesirable leakage of shaving aid.

However, the present disclosure is not limited to this configuration, and the discharge end 164 may not have the projection portion 1642.

The inlet portion end 166 may receive the shaving aid from a shaving aid containing member (not shown) of the razor handle 140 and deliver the same to the discharge end 164.

The blade housing 110 may include the inlet portions 112.

The inlet portion 112 may be an area on the blade housing 110, into which the shaving aid discharged from the discharge end 164 is introduced.

The inlet portion 112 may be disposed on the back of the blade housing 110 for introduction of the shaving aid.

The shaving aid introduced into the inlet portion 112 may be discharged from the front surface of the blade housing 110 through the discharge portion 114.

The inlet portion 112 may be disposed at a position corresponding to the discharge portion 114. In this case, the inlet portion 112 and the discharge portion 114 may define a through-hole that penetrates the blade housing 110 in the thickness direction. Here, the thickness direction refers to a direction in which the thickness of the blade housing 110 is formed. For example, in FIG. 2, the thickness direction is a direction parallel to the X-axis.

However, the present disclosure is not limited to this configuration. For example, the inlet portion 112 may be arranged to be spaced apart from the discharge portion 114, so that the shaving aid is introduced at a position different from where it is discharged. In this case, the blade housing 110 may include a communication portion (not shown) interconnecting the inlet portion 112 and the discharge portion 114.

The head portion 142 may include a head frame 1422, at least one or more bosses 1424, and the receiving space 1426.

Inside the head frame 1422, the receiving space 1426 is configured to accommodate the supplying member body 162.

The bosses 1424 may protrude laterally from the head frame 1422 and may be inserted into boss holes 115 formed on the blade housing 110.

The bosses 1424 are inserted into the boss holes 115 to define a rotation axis RA parallel to the longitudinal direction of the cutting edge. The razor cartridge 12 may pivot with respect to the head portion 142 around the rotation axis RA.

In FIGS. 2 and 3, the aid supplying member 160 is illustrated as being disposed on the razor handle 140, but the present disclosure is not limited to this configuration.

For example, the aid supplying member 160 may be disposed in any one of the razor cartridge 12 and a connector (not shown) that connects between the razor cartridge 12 and the razor handle 140.

When the aid supplying member 160 is disposed on the connector, coupling the connector in connection with the razor cartridge 12 further to the razor handle 140 allows the aid storage (not shown) of the razor handle 140 to be in communicative contact with the aid supplying member 160 disposed on the connector. Thus, the shaving aid in the aid containing member may be delivered to the aid supplying member 160 and discharged.

In addition, FIGS. 2 and 3 illustrate that the head portion 142 and the aid supplying member 160 are made of separate members from each other, but the present disclosure is not limited thereto.

For example, the aid supplying member 160 may be integrally formed with any one of the connector (not shown), the razor cartridge 12, and the razor handle 140. Still referring to FIGS. 2 and 3, the razor handle 140 may include a release or ejecting member 148.

The ejecting member 148 may release the razor cartridge 12 from the razor handle 140 through an action for ejection.

The action for ejection may be, but not limited to, a pushing operation or a sliding operation.

Figure 4:
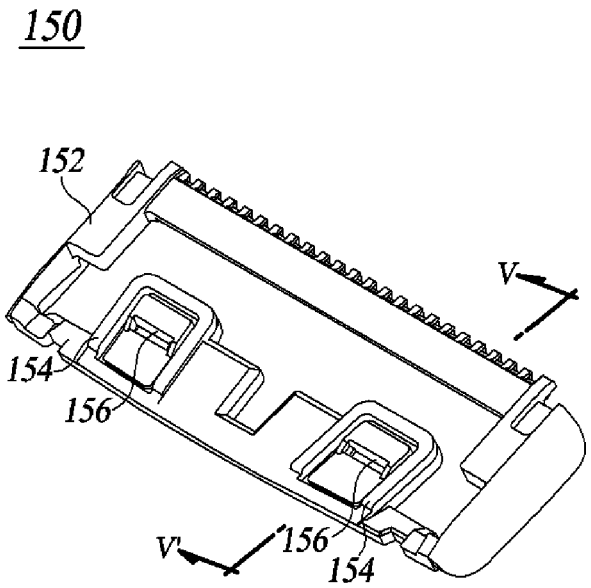
FIG. 4 is a perspective view of a receiving member according to at least one embodiment of the present disclosure.

FIG. 4 is a perspective view of a receiving unit 150 according to at least one embodiment of the present disclosure.

Figure 5:
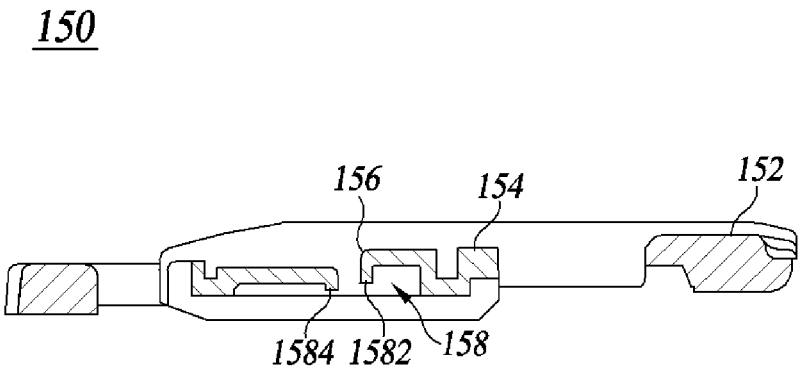
FIG. 5 is a side cross-sectional view of the receiving member according to at least one embodiment showing a cross-section in the V-V' direction in FIG. 4.

FIG. 5 is a side cross-sectional view of the receiving member 150 according to at least one embodiment showing a cross-section in the V-V' direction in FIG. 4.

As shown in FIGS. 4 and 5, the receiving unit 150 may include a receiving member body 152, at least one or more receiving valves 154, at least one or more receiving holes 156, and at least one or more tightening ends 158.

The receiving member body 152 may be detachably coupled to the rear surface of the blade housing 110.

Each receiving valve 154 may prevent backflow of the shaving aid ejected from the discharge end 164 of the aid supplying member 160 to prevent leakage of the razor cartridge 12 at an unintended position.

The receiving valve 154 may be disposed on the receiving member body 152 at a position corresponding to the inlet portion 112, and the receiving hole 156 may be formed on one side of the receiving valve 154.

When the aid supplying member 160 is inserted by the discharge end 164 into the receiving hole 156, the discharge end 164 may be accommodated in a space between the receiving valve 154 and the inlet portion 112.

The receiving valve 154 and the receiving hole 156 may include an elastic material. This enables the receiving valve 154 and the receiving hole 156 to securely maintain sealing between the discharge end 164 and the receiving hole 156 even when the razor cartridge 12 pivots.

The receiving valve 154 and the receiving hole 156 may be made of, but not limited to, a rubber material.

The tightening end 158 of the receiving unit 150 may extend toward the inlet portion 112 from at least a portion of the circumference of the receiving hole 156.

The tightening end 158 may wrap at least a portion of the outer circumferential surface of the discharge end 164 inserted into the receiving hole 156, thereby sealing more firmly between the discharge end 164 and the receiving hole 156.

Figure 6A:
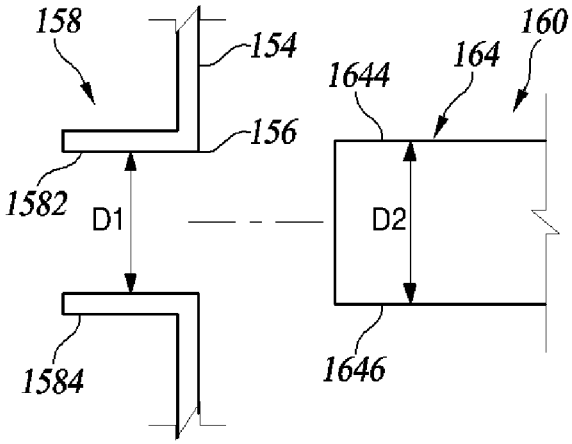
FIGS. 6A and 6B illustrate that a discharge end is inserted into a receiving hole according to at least one embodiment of the present disclosure.
Figure 6B:
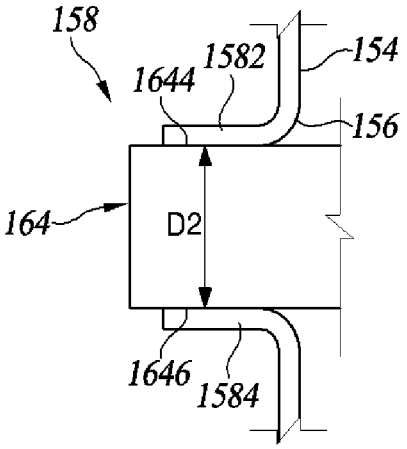

FIGS. 6A and 6B illustrate that the discharge end 164 of the aid supplying member 160 is inserted into the receiving hole 156 according to at least one embodiment of the present disclosure.

Specifically, FIG. 6A shows the state before the discharge end 164 is inserted into the receiving hole 156, and FIG. 6B shows the state after the discharge end 164 is inserted in the receiving hole 156.

In FIGS. 6A and 6B, it is assumed that the razor cartridge 12 is pivoted vertically with respect to the razor handle 140.

FIGS. 6A and 6B illustrate the discharge end 164 with the projection portion 1642 omitted.

Meanwhile, the discharge end 164 may have a cross section different from that of the tightening end 158. To compensate for this difference, FIGS. 6A and 6B illustrate the discharge end 164 and the tightening end 158 by their equivalent cylinder and cone having equal cross-sectional areas cut perpendicular to the longitudinal direction.

In this regard, the present disclosure compares the cross-sectional area of the discharge end 164 with that of the tightening end 158 by using effective diameters. Here, the effective diameter of a figure refers to the diameter of a circle having the same area as the figure.

In this specification, the area of a figure is defined by the circumference of the figure. Therefore, the hollow region located in the figure is not taken into account for the calculation of the cross-sectional area and effective diameter.

As shown in FIG. 6A and FIG. 6B, the discharge end 164 may include a first surface 1644 and a second surface 1646.

The first surface 1644 and the second surface 1646 are parallel to each other, and even when they go toward the free end of the discharge end 164, the effective diameter, which is the distance therebetween, may be maintained at D2. Here, the free end of the discharge end 164 refers to one of two ends of the discharge end 164, which is adjacent to the region where the shaving aid is ejected.

The tightening end 158 may include a first tightening surface 1582 and a second tightening surface 1584.

When the discharge end 164 is inserted into the receiving hole 156, the first tightening surface 1582 may face the first surface 1644 with the second tightening surface 1584 facing the second surface 1646.

As shown in FIG. 6A, with the discharge end 164 inserted into the receiving hole 156, the first tightening surface 1582 and the second tightening surface 1584 are parallel to each other, and even when they go toward the free end of the tightening end 158, the effective diameter, which is the distance therebetween, may be maintained at D1 that is less than D2. Here, the free end of the tightening end 158 refers to one of two ends of the tightening end 158, which is spaced apart from the receiving hole 156.

As shown in FIG. 6B, when the discharge end 164 is inserted into the receiving hole 156, the receiving hole 156 and the tightening end 158 may have their effective diameter expanded, by elastic deformation, to effective diameter D2 of the discharge end 164.

In this case, the receiving hole 156 and the tightening end 158 may depress the outer circumferential surface of the discharge end 164 more strongly, whereby the sealing performance can be further improved.

Figure 7:
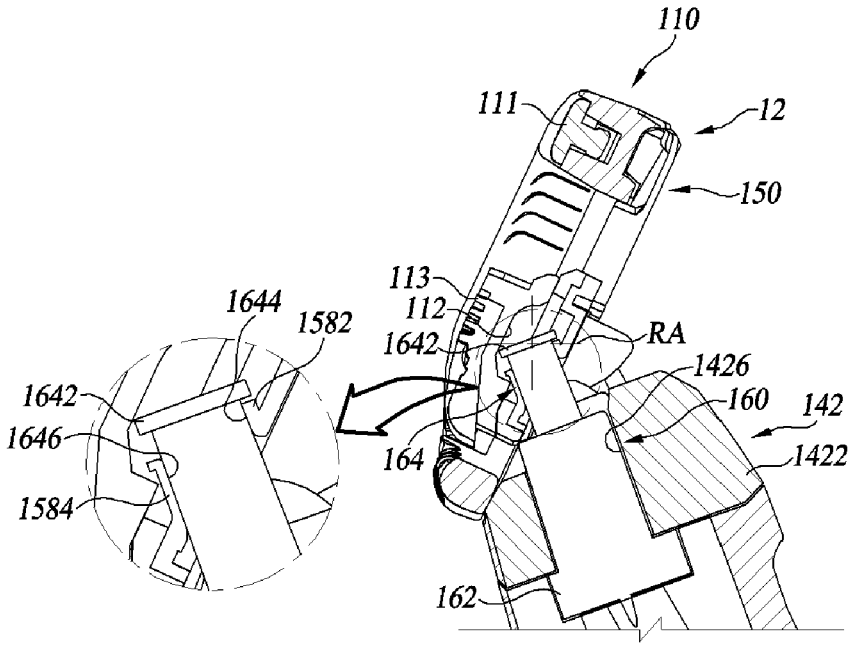
FIG. 7 is a side cross-sectional view of a razor assembly according to at least one embodiment of the present disclosure.

FIG. 7 is a side cross-sectional view of the razor assembly 10 according to at least one embodiment.

Figure 8:
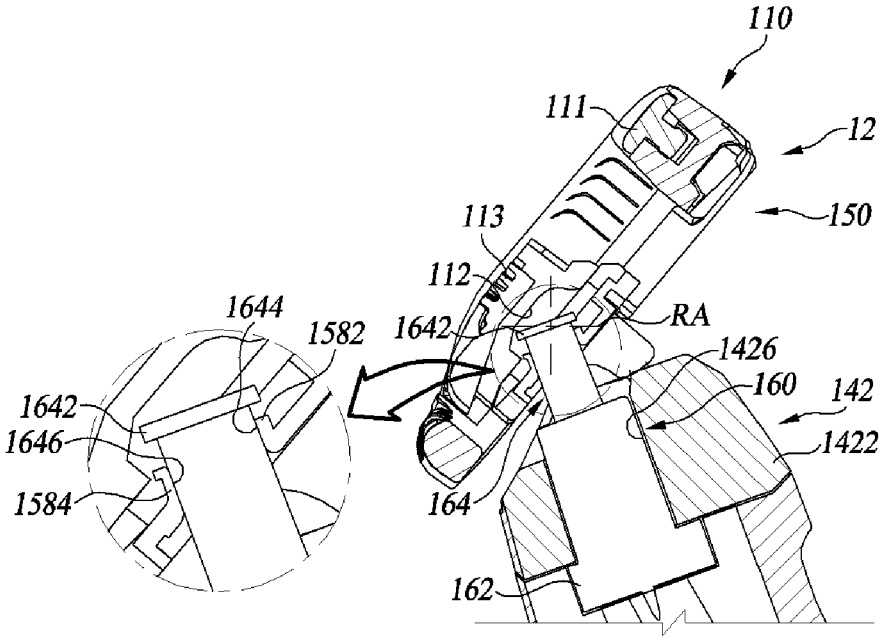
FIG. 8 is a side cross-sectional view of the razor assembly of FIG. 7 having been pivoted.

FIG. 8 is a side cross-sectional view of the razor assembly 10 of FIG. 7 having been pivoted.

As shown in FIGS. 7 and 8, the blade housing 110 may pivot with respect to the head portion 142 around the rotation axis RA that is parallel to the longitudinal direction of the cutting edge. Rotation axis RA may be defined by inserting the bosses 1424 of the head portion 142 into the boss holes 115 of the blade housing 110.

The discharge ends 164 inserted into the receiving holes 156 may not interfere with the inlet portions 112 when the blade housing 110 rotates around the rotation axis RA. Accordingly, the blade housing 110 can pivot freely with respect to the head portion 142.

Rotation axis RA may penetrate the discharge ends 164 when the blade housing 110 rotates around the rotation axis RA. This can minimize the space occupied by the discharge end 164 when the blade housing 110 is rotated, thereby minimizing the interference of the discharge ends 164 with the inlet portions 112.

Alternatively, rotation axis RA may be configured to be positioned adjacent to the discharge ends 164 or to penetrate the inlet portions 112 without passing through the discharge ends 164.

On the other hand, since the tightening end 158 is made of an elastic material, thereby firmly maintaining tight contact with the discharge end 164 regardless of the degree of pivot of the blade housing 110.

Specifically, during the pivot operation of the blade housing 110, the first tightening surface 1582 and the second tightening surface 1584 can maintain a tight contact respectively with the first surface 1644 and the second surface 1646 of the discharge end 164.

The first tightening surface 1582 and the second tightening surface 1584 may be formed to be isolated within the tightening end 158 so that they exhibit freely elastic deformation when the razor cartridge 12 pivots. However, the present disclosure is not limited to this configuration.

FIGS. 7 and 8 illustrate that the tightening end 158 extends from the entire circumference of the receiving hole 156, but the present disclosure is not limited thereto.

For example, the tightening end 158 may be formed to extend only from the circumferential line segment of the receiving hole 156 in contact with the first surface 1644 and the second surface 1646 of the discharge end 164. In that case, the effective diameter of the tightening end 158 may be defined by the area between the first tightening surface 1582 and the second tightening surface 1584.

The second embodiment of the present disclosure shown in FIGS. 9 to 11, which will be described below, differs from the embodiment of the present disclosure shown in FIGS. 1 to 8 by a receiving valve that includes a raised portion. The following description will concentrate on the distinctive features according to the second embodiment of the present disclosure, omitting a repeated description of a configuration substantially the same as the at least one embodiment of the present disclosure.

Figure 9:
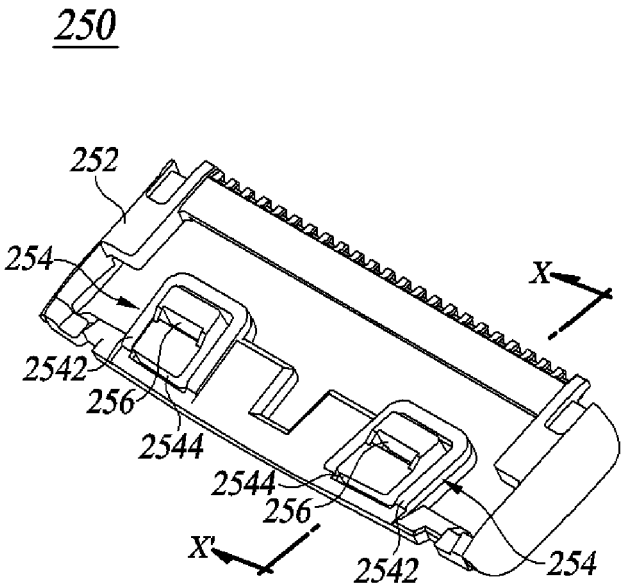
FIG. 9 is a perspective view of a receiving member according to a second embodiment of the present disclosure.

FIG. 9 is a perspective view of a receiving member 250 according to a second embodiment of the present disclosure.

Figure 10:
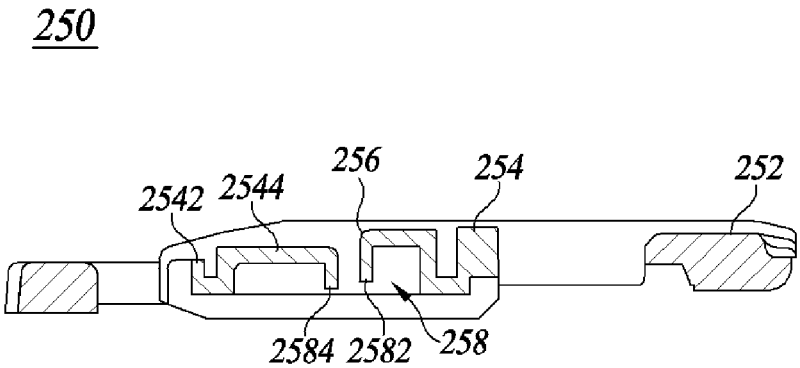
FIG. 10 is a side cross-sectional view of the receiving member according to the second embodiment showing a cross-section in the X-X' direction in FIG. 9.

FIG. 10 is a side cross-sectional view of the receiving unit 250 according to the second embodiment showing a cross-section in the X-X' direction in FIG. 9.

Figure 11:
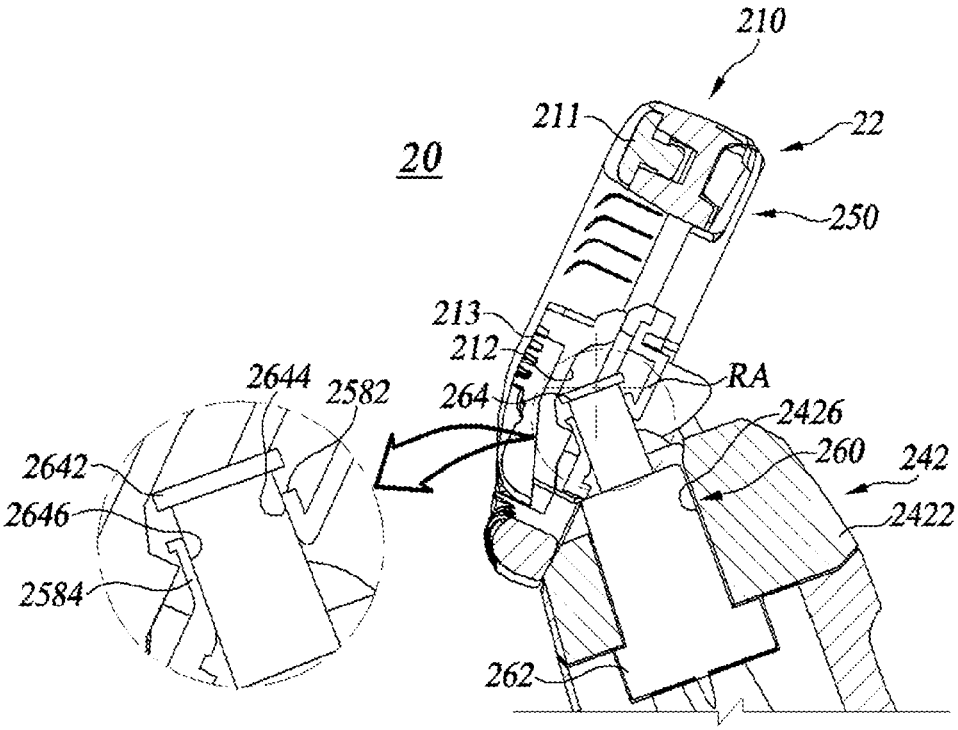
FIG. 11 is a side cross-sectional view of a razor assembly according to the second embodiment of the present disclosure.

FIG. 11 is a side cross-sectional view of the razor assembly 20 according to the second embodiment of the present disclosure.

As shown in FIGS. 9 to 11, the receiving member 250 may include a receiving member body 252, at least one more receiving valves 254, at least one more receiving holes 256, and at least one more tightening ends 258.

The receiving member body 252 may be detachably coupled to the rear surface of a blade housing 210.

The receiving valve 254 may be disposed on the receiving member body 252 at a position corresponding to the inlet portion 212, and the receiving hole 256 may be formed on one side of the receiving valve 254.

The razor assembly 20 is provided with an aid supplying member 260 having at least one or more discharge ends 264 which are each inserted into the receiving hole 256 and accommodated in a space between the receiving valve 254 and the inlet portion 212.

The receiving valve 254 and the receiving hole 256 may be made of an elastic material. This can firmly maintain a tight sealing between the discharge end 264 and the receiving hole 256.

The tightening end 258 may extend from at least a portion of the periphery of the receiving hole 256 toward the inlet portion 212.

The tightening end 258 may wrap at least a portion of the outer circumferential surface of the discharge end 264 inserted into the receiving hole 256, thereby sealing more firmly between the discharge end 264 and the receiving hole 256.

The receiving valve 254 may include a base portion 2542 and a hollow raised portion 2544.

The base portion 2542 may be disposed on the receiving member body 252 at a position corresponding to the inlet portion 212. The raised portion 2544 is raised from the base portion 2542, and it may have one side formed with a receiving hole 256.

Since the raised portion 2544 has a raised shape from the base portion 2542, it may be spaced higher from the inlet portion 212. This may widen the space between the receiving valve 254 and the blade housing 210.

In this case, the receiving hole 256 formed in the raised portion 2544 may also be spaced higher from the inlet portion 212. This helps to prolong the length of the tightening end 258 extending from the receiving hole 256. Accordingly, the tightening end 258 may contact the outer peripheral surface of the discharge end 264 over a larger area.

Thus, the razor assembly 20 according to the second embodiment of the present disclosure has the effect of more firmly sealing between the discharge ends 264 and the receiving holes 256.

The third embodiment of the present disclosure shown in FIGS. 12A and 12B to be described below, differs from the embodiment of the present disclosure shown in FIGS. 1 to 8 by the effective diameter of the discharge end decreasing as it goes toward its free end. The following description will concentrate on the distinctive features according to the third embodiment of the present disclosure, omitting a repeated description of a configuration substantially the same as the at least one embodiment of the present disclosure.

Figure 12A:
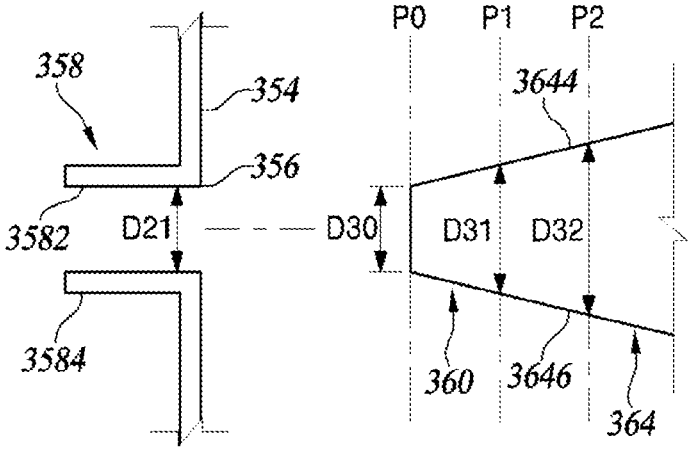
FIGS. 12A and 12B illustrate a tightening end and a discharge end according to a third embodiment of the present disclosure.
Figure 12B:
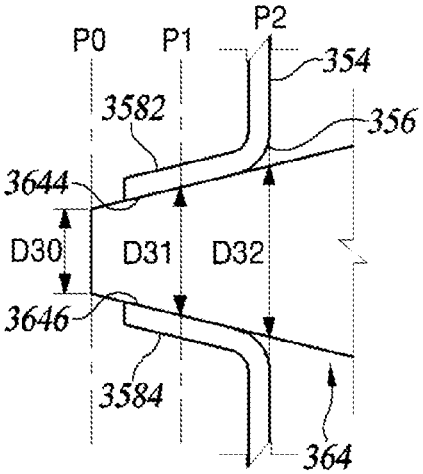

FIGS. 12A and 12B illustrate a tightening end 358 of a receiving unit (not shown) and a discharge end 364 of an aid supplying member 360 according to a third embodiment of the present disclosure.

Specifically, FIG. 12A shows the state before the discharge end 364 is inserted into the receiving hole 356, and FIG. 12B shows the state after the discharge end 364 is inserted by up to its second point P2 in the receiving hole 356.

In FIGS. 12A and 12B, it is assumed that the relevant razor cartridge is pivoted perpendicular to the relevant razor handle.

FIGS. 12A and 12B illustrate the discharge end 364 and the tightening end 358 by their equivalent cylinder and cone having equal cross-sectional areas cut perpendicular to the longitudinal direction.

As shown in FIG. 12A and FIG. 12B, the discharge end 364 may include a first surface 3644 and a second surface 3646.

The first surface 3644 and the second surface 3646 may have a shape that converges with each other toward a free end P0 of the discharge end 364.

For example, the discharge end 364 has an effective diameter D31 at a first point P1 adjacent to free end P0 thereof, which is larger than an effective diameter D30 at free end P0 and smaller than an effective diameter D32 at a second point P2 that is farther than first point P1 from free end P0.

The tightening end 358 may include a first tightening surface 3582 and a second tightening surface 3584.

When the discharge end 364 is inserted into the receiving hole 356, the first tightening surface 3582 may face the first surface 3644, and the second tightening surface 3584 may face the second surface 3646.

As shown in FIG. 12A, before the discharge end 364 is inserted into the receiving hole 356, the first tightening surface 3582 and the second tightening surface 3584 are parallel to each other, and they can maintain the effective diameter, which is the distance therebetween, at D21 which is smaller than D32 throughout the tightening end 358 as far as the free end of the tightening end 358.

In this case, effective diameter D21 may have a value equal to or smaller than effective diameter D30 at the free end P0 of the discharge end 364, but the present disclosure is not limited thereto.

As shown in FIG. 12B, when the discharge end 364 is inserted by up to second point P2 into the receiving hole 356, the receiving hole 356 may have its effective diameter expanded, by elastic deformation, to be as large as D31.

Meanwhile, since the first surface 3644 and the second surface 3646 have a shape converging with each other when the discharge end 364 is inserted into the receiving hole 356, a part of the receiving hole 356 may be naturally rolled into the inner side of the receiving valve 354 to maintain a tight engagement with the outer peripheral surface of the discharge end 364.

This widens the areas of the first adhesion surface 3852 and the second adhesion surface 3584, whereby sealing performance may be further improved.

The fourth embodiment of the present disclosure shown in FIGS. 13A and 13B to be described below, differs from the embodiment of the present disclosure shown in FIGS. 1 to 8 by the effective diameter of the tightening end decreasing at it goes toward its free end. The following description will concentrate on the distinctive features according to the fourth embodiment of the present disclosure, omitting a repeated description of a configuration substantially the same as the at least one embodiment of the present disclosure.

Figure 13A:
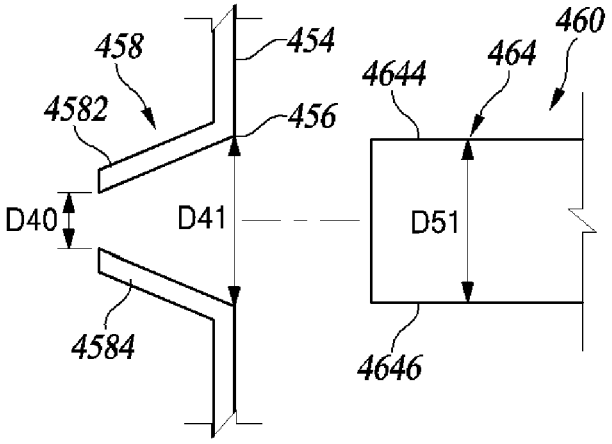
FIGS. 13A and 13B illustrate a tightening end and a discharge end according to a fourth embodiment of the present disclosure.
Figure 13B:
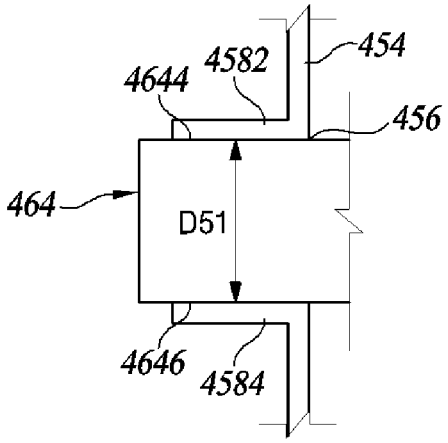

FIGS. 13A and 13B illustrate a tightening end 458 and a discharge end 464 according to a fourth embodiment of the present disclosure.

In particular, FIG. 13A shows the state before the discharge end 464 is inserted into the receiving hole 456, and FIG. 13B shows the state after the discharge end 464 is inserted in the receiving hole 456.

In FIGS. 13A and 13B, it is assumed that the relevant razor cartridge is pivoted perpendicular to the relevant razor handle.

FIGS. 13A and 13B illustrate the discharge end 464 and the tightening end 458 by their equivalent cylinder and cone having equal cross-sectional areas cut perpendicular to the longitudinal direction.

As shown in FIG. 13A and FIG. 13B, the discharge end 464 may include a first surface 4644 and a second surface 4646.

The first surface 4644 and the second surface 4646 are parallel to each other, and they can maintain the effective diameter, which is the distance therebetween, at D51 throughout the discharge end 464 as far as the free end of the discharge end 464.

The tightening end 458 may include a first tightening surface 4582 and a second tightening surface 4584.

When the discharge end 464 is inserted into the receiving hole 456, the first tightening surface 4582 may face the first surface 4644, and the second tightening surface 4584 may face the second surface 4646.

As shown in FIG. 13A, before the discharge end 464 is inserted into the receiving hole 456, the first tightening surface 4582 and the second tightening surface 4584 may have a shape converging with each other as they go toward the free end of the tightening end 458.

For example, an effective diameter D40 at the free end of the tightening end 458 has a smaller value than an effective diameter D41 at the receiving hole 456, which is spaced apart from the free end.

In this case, effective diameter D41 may be the same or smaller than the effective diameter of D51 at the free end of the discharge end 464, but the present disclosure is not limited thereto.

As shown in FIG. 13B, when the discharge end 464 is inserted into the receiving hole 456, they have their effective diameters expanded, by elastic deformation, to be as large as D51.

On the other hand, the first tightening surface 4582 and the second tightening surface 4584 are deflected in a direction converging with each other before the discharge end 464 is inserted into the receiving hole 456.

Thus, when the discharge end 464 is inserted into the receiving hole 456, the first tightening surface 4582 and the second tightening surface 4584, thanks to their biasing forces, can be more firmly adhered to the first surface 4644 and the second surface 4646 of the discharge end 464.

The third and fourth embodiments of the present disclosure shown in FIGS. 12A to 13B are only some of the various embodiments of the present disclosure. Therefore, the discharge end and the tightening end according to the present disclosure may have various shapes other than those illustrated by the above-described embodiments.

As described above, according to some embodiments of the present embodiment, the razor assembly has an effect of smoothly spraying the shaving aid regardless of the degree of pivot of the razor cartridge.

Although exemplary embodiments of the present disclosure have been described for illustrative purposes, those skilled in the art will appreciate that various modifications, additions, and substitutions are possible, without departing from the idea and scope of the claimed invention. Therefore, exemplary embodiments of the present disclosure have been described for the sake of brevity and clarity. The scope of the technical idea of the present embodiments is not limited by the illustrations. Accordingly, one of ordinary skill would understand the scope of the claimed invention is not to be limited by the above explicitly described embodiments but by the claims and equivalents thereof.

What is claimed is:

1. A razor assembly, comprising:

at least one shaving blade having a cutting edge;

a blade housing configured to accommodate the at least one shaving blade such that a width direction of the blade housing is in parallel with a longitudinal direction of the cutting edge and comprising an inlet portion and a discharge portion configured to discharge a shaving aid delivered from the inlet portion;

a receiving member disposed on a rear surface of the blade housing and comprising a receiving valve and a receiving hole formed on one side of the receiving valve; and an aid supplying member comprising a discharge end configured to discharge the shaving aid to the inlet portion, wherein at least a portion of the discharge end, which is inserted into the receiving hole, is accommodated between the receiving valve and the blade housing.

2. The razor assembly of claim 1, wherein the receiving valve comprises an elastic material.

3. The razor assembly of claim 2, wherein, prior to insertion of the at least a portion of the discharge end into the receiving hole, the at least a portion of the discharge end has an effective diameter that is larger than an effective diameter of the receiving hole.

4. The razor assembly of claim 3, wherein the receiving member is elastically deformed such that the receiving hole surrounds at least a portion of an outer peripheral surface of the discharge end when the at least a portion of the discharge end is inserted into the receiving hole.

5. The razor assembly of claim 2, wherein the receiving member further comprises:

a tightening end extending toward the inlet portion from at least a portion of a periphery of the receiving hole.

6. The razor assembly of claim 5, wherein the tightening end is shaped to have an effective diameter decreasing toward a free end of the tightening end when the discharge end is not inserted into the receiving hole.

7. The razor assembly of claim 5, wherein at least a portion of the discharge end is shaped to have an effective diameter decreasing toward a free end of the discharge end.

8. The razor assembly of claim 1, wherein the discharge end comprises:

a protrusion portion protruding from an outer peripheral surface of the discharge end, and wherein the protrusion portion is accommodated between the receiving valve and the blade housing.

9. The razor assembly of claim 1, wherein the receiving member further comprises:

a receiving member body disposed on the rear surface of the blade housing, and wherein the receiving valve comprises:

a base portion disposed on the receiving member body; and a hollow raised portion that is raised from the base portion and has one side formed with the receiving hole.

10. The razor assembly of claim 1, further comprising a razor handle, wherein:

the blade housing is configured to be pivotable with respect to the razor handle about a rotational axis parallel to the longitudinal direction of the cutting edge; and the discharge end does not interfere with the inlet portion when the blade housing pivots about the rotational axis.

11. The razor assembly of claim 10, wherein the rotational axis extends penetrating through the discharge end when the blade housing pivots about the rotational axis.

12. A razor cartridge configured to receive a shaving aid from an aid supplying member, the razor cartridge comprising:

at least one shaving blade having a cutting edge;

a blade housing configured to accommodate the at least one shaving blade such that a width direction of the blade housing is in parallel with a longitudinal direction of the cutting edge and comprising an inlet portion configured to let the shaving aid in and a discharge portion configured to discharge the shaving aid that is delivered from the inlet portion; and a receiving member disposed on a rear surface of the blade housing and comprising a receiving valve and a receiving hole formed on one side of the receiving valve, wherein the receiving valve is configured to receive at least a portion of the aid supplying member through the receiving hole.

* * * * *